US011326313B2

(12) United States Patent
Motavalli et al.

(10) Patent No.: US 11,326,313 B2
(45) Date of Patent: May 10, 2022

(54) METHOD FOR PRE-STRESSING A STEEL STRUCTURE, AND STEEL STRUCTURE PRE-STRESSED USING SAID METHOD

(71) Applicant: S&P CLEVER REINFORCEMENT COMPANY AG, Seewen (CH)

(72) Inventors: Masoud Motavalli, Forch (CH); Elyas Ghafoori, Dübendorf (CH)

(73) Assignee: S&P CLEVER REINFORCEMENT COMPANY AG

( * ) Notice: Subject to any disclaimer, the term of this patent is extended or adjusted under 35 U.S.C. 154(b) by 0 days.

(21) Appl. No.: 16/874,643

(22) Filed: May 14, 2020

(65) Prior Publication Data

US 2020/0299911 A1 Sep. 24, 2020

Related U.S. Application Data

(63) Continuation of application No. 14/898,452, filed as application No. PCT/CH2014/000049 on Apr. 16, 2014, now abandoned.

(30) Foreign Application Priority Data

May 14, 2013 (CH) ..... CH950/2013

(51) Int. Cl.
*E01D 22/00* (2006.01)
*E04C 3/10* (2006.01)
(Continued)

(52) U.S. Cl.
CPC ..... *E01D 22/00* (2013.01); *E01D 6/00* (2013.01); *E04B 1/24* (2013.01); *E04C 3/10* (2013.01);
(Continued)

(58) Field of Classification Search
CPC ..... E01D 22/00; E01D 6/00; E01D 2101/28; E01D 19/16; E01D 2101/32; E04B 1/24;
(Continued)

(56) References Cited

U.S. PATENT DOCUMENTS 238,130 A ‡ 2/1881 Lawrence ..... E01D 6/00 14/11
762,632 A ‡ 6/1904 Headley ..... E01D 6/00 14/4
(Continued)

FOREIGN PATENT DOCUMENTS

AU 2014268098 B2 4/2018
EA 031304 B1 12/2018
(Continued)

OTHER PUBLICATIONS

All-Fab, "Truss Terminology", https://www.all-fab.com/wp-content/uploads/2015/12/Truss-Terminology.pdf (published on May 16, 2017 on http://www.all-fab.com/wp-content/uploads/2015/12/Truss-Terminology.pdf) (Year: 2017).*
(Continued)

*Primary Examiner* — Theodore V Adamos
(74) *Attorney, Agent, or Firm* — CUSPA Technology Law Associates, P.A.; Yi Li

(57) ABSTRACT

According to the method, at least one carbon fibre-reinforced polymer band is joined to the steel structure at the end regions thereof, capable of transferring tensile forces. Subsequently, at least one lifting element (7) disposed between the carbon fibre-reinforced polymer band (4) and the steel girder (3) to be reinforced in a region between these end anchorages (5), is extended substantially perpendicular to the carbon fibre-reinforced polymer band (4). So, a tensile force stress is generated between the end regions of the carbon fibre-reinforced polymer band (4). Then, a steel girder treated in such a manner includes at least one carbon
(Continued)

Figure 1:
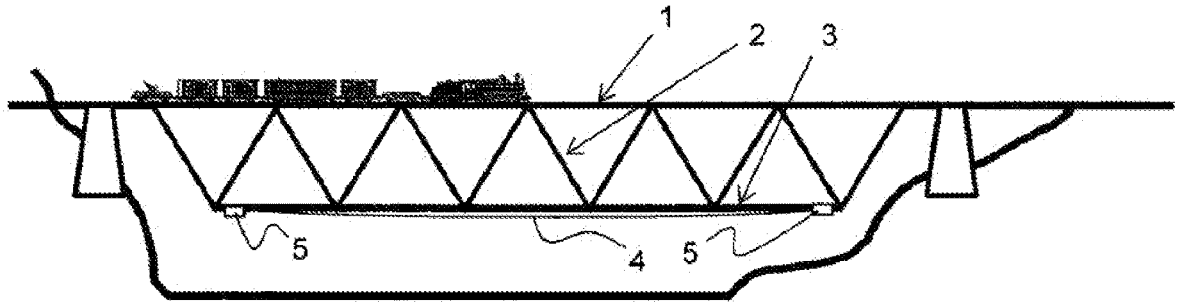

fibre-reinforced polymer band, which is each joined to the steel structure (1) at the end regions thereof, capable of transferring tensile forces. In the region between these end regions, a lifting element (7) is disposed between the carbon fibre-reinforced polymer band (4) and the steel girder (3) to be reinforced, by means of which the carbon fibre-reinforced polymer band (4) is subjected to tensile stress by lifting away from the steel girder (3). The tensile force is transferred to the steel girder (3) via the anchoring elements (5).

17 Claims, 2 Drawing Sheets

(51) Int. Cl.

| | |
|---|---|
| ***E04C 5/08*** | (2006.01) |
| ***E01D 6/00*** | (2006.01) |
| ***E04B 1/24*** | (2006.01) |
| ***E04G 23/02*** | (2006.01) |
| ***E01D 101/32*** | (2006.01) |

(52) U.S. Cl.
CPC ..... *E04C 5/085* (2013.01); *E04G 23/0218* (2013.01); *E01D 2101/32* (2013.01)

(58) Field of Classification Search
CPC ... E04B 1/28; E04C 3/10; E04C 5/085; E04C 3/185; E04G 23/0218; E04G 21/12
See application file for complete search history.

(56) References Cited

U.S. PATENT DOCUMENTS 3,427,811 A ‡ 2/1969 White ..... E21D 11/006 405/259.3
3,909,863 A ‡ 10/1975 Macrander ..... B66C 6/00 14/74.5
4,006,523 A * 2/1977 Mauquoy ..... E04C 3/293 29/452
4,021,875 A ‡ 5/1977 Abell ..... E01D 15/12 14/10
4,129,915 A ‡ 12/1978 Abell ..... E01D 15/124 14/10
4,223,506 A ‡ 9/1980 Blair ..... E04B 1/24 52/167.1
4,589,157 A ‡ 5/1986 Richard ..... E01D 2/00 14/14
4,631,772 A ‡ 12/1986 Bonasso ..... E01D 1/00 14/20
4,987,629 A ‡ 1/1991 Muller ..... E01D 2/04 14/14
5,313,749 A * 5/1994 Conner ..... E04C 3/10 52/223.12
6,065,257 A ‡ 5/2000 Nacey ..... E01D 2/00 14/73
6,170,209 B1 ‡ 1/2001 Dagher ..... E04C 3/185 52/223.1
6,571,518 B1 ‡ 6/2003 Barley ..... E04C 5/127 405/259.1
6,584,738 B1 * 7/2003 Andra ..... E04G 21/121 52/223.13
6,892,410 B2 * 5/2005 Tokuno ..... E01D 1/005 14/13
7,047,704 B1 ‡ 5/2006 Han ..... E01D 2/00 52/223.14
7,748,180 B1 ‡ 7/2010 Plavidal ..... E04B 5/12 52/223.11
8,925,279 B2 ‡ 1/2015 Pantelides ..... E01D 19/16 52/223.1
2002/0194808 A1 ‡ 12/2002 Ratliff ..... E04C 3/02 52/633
2005/0247016 A1 * 11/2005 Andra ..... E04C 5/127 52/745.21
2005/0252116 A1 * 11/2005 Maier ..... E04G 23/0218 52/223.1
2011/0072745 A1 * 3/2011 Pantelides ..... E01D 19/16 52/223.13
2011/0203195 A1 ‡ 8/2011 Hillman ..... E01D 2/02 52/80.1
2012/0180407 A1 * 7/2012 Rees ..... E04G 23/0218 52/173.3

FOREIGN PATENT DOCUMENTS

EP 1396582 A2 ‡ 3/2004 ..... E01D 1/005
EP 2997197 B1 4/2020
NZ 713701 B2 4/2019

OTHER PUBLICATIONS

1) Communication under Rule 71(3) EPC from European Patent Office in the counterpart European patent application No. 14722518.9, dated Mar. 4, 2020, including an English translation of the first page of the Rule 71(3) EPC communication (2) The text intended for grant enclosed in the Communication under Rule 71(3) EPC, including an English translation of the claims therein.‡
International Preliminary Report on Patentability, Chapter I (English translation from WIPO).‡
International Search Report.‡
Notice of Allowance in counter-part Korean patent application No. 10-2015-7035406 dated Apr. 26, 2021 and its English translation, with an English translation of allowed claims.

* cited by examiner
‡ imported from a related application

METHOD FOR PRE-STRESSING A STEEL STRUCTURE, AND STEEL STRUCTURE PRE-STRESSED USING SAID METHOD

This application is a continuation of patent application Ser. No. 14/898,452, filed Dec. 14, 2015, which is a national phase of PCT application No. PCT/CH2014/000049, filed Apr. 16, 2014, which claims priority of Swiss patent application No. 950/2013, filed May 14, 2013. The parent applications are hereby incorporated by reference.

This invention relates to a method for pre-stressing a steel structure, and the steel structure existing both on a new construction and preferably on an existing one, especially on bridge constructions. According to a study by Bien J. Elfgren L. and Olofsson J. entitled *Sustainable Bridges, Assessment for Future Traffic Demands and Longer Lives*, Wroclaw, Dolnoslaskie Wydawnictwo Edukacyjne, 2007, the European Railway Authorities confirm that there are about 220,000 railway bridges in Europe alone, and these are located in different climatic regions. Approximately 22% of which are metal or steel constructions, which are also often referred to as steel bridges. 3% are cast iron bridges, 25% are welded steel constructions, and 53% are made of steel, and about 20% are made of a material, not clearly identified. 28% of these metal constructions are more than 100 years old and almost 70% of the bridges are more than 50 years old. Since today trains are becoming longer, heavier and faster, the loading of these bridges is increasing very much. Each axle load generates vibrations, and thus, small cracks and gaps develop with time in the structures, and the fatigue of the carrier is progressing ever more quickly.

Tests at EMPA in CH-Dübendorf demonstrated that the steel girders can be strengthened in principle by the application of carbon fibre-reinforced polymers (CFRP=Carbon Fiber Reinforced Polymers). These CFRP are attached to the steel girders by means of adhesives and are capable of absorbing a tensile stress, which slows down or even stops the crack formation. Nevertheless, adhesives are only partially suitable in many places, because steel is heated to high temperatures by the sunlight and this can bring the adhesive to the glass transformation limit thereof. The publications *Engineering Structures* 45 (2012) 270-283 and the international *Journal of Fatigue* 44 (2012) 303-315 in Elsevier Journal should be followed in this respect.

Another issue is the galvanic corrosion. Although, CFRP are not corrosive, they form galvanic cells in combination with steel. Then, there are many riveted steel bridges. In these, the problem is how best to attach the flat CFRP bands to the steel girders. And finally, the protection of monuments should often be taken into account, in which for instance it is required that historically important structures must again be restored into their original state where appropriate, which could hardly be achieved with glued on CFRP bands. And finally, it would be desirable, not only to strengthen the structures, but also to pre-stress, thus in order to completely close the already existing cracks and gaps and to continuously prevent further growth of these cracks and gaps. Therefore, one of the most important objects of a reinforcement system is the appropriate selection of the mechanical anchoring system, so that this develops sufficient clamping force, is subjected to minimal corrosion, if possible, requires no direct contact of the CFRP bands with the steel, and the stress-initiation in the anchoring system takes place gradually.

It is the object of the present invention to specify a method for pre-stressing a steel structure, and also a steel structure prestressed thereby. Therefore, the crack formation on a new or existing steel structure should be prevented by means of this pre-stressing, or already existing cracks should be closed or their further growth should be stopped or at least slowed down.

The object is accomplished by a method for pre-stressing a steel structure, in which at least one carbon fibre-reinforced polymer band each is joined to a steel girder to be reinforced at the end regions thereof, capable of transferring tensile forces, and subsequently at least one lifting element disposed between the respective carbon fibre-reinforced polymer band and the steel girder to be reinforced, is extended in a region between these end anchorages, substantially perpendicular to the carbon fibre-reinforced polymer band, for causing a tensile stress between the end regions of the respective carbon fibre-reinforced polymer band.

The object is further accomplished by a steel structure, which is characterized by that at least one carbon fibre-reinforced polymer band each is joined to a steel girder of the steel structure to be reinforced at end regions thereof, capable of transferring tensile forces, wherein at least one lifting element disposed between the respective carbon fibre-reinforced polymer band and the steel girder to be reinforced, is disposed in the region between these end regions, by means of which, the respective carbon fibre-reinforced polymer band is subjected to tensile stress from the steel girder by substantially perpendicular lifting of the carbon fibre-reinforced polymer band.

The invention is schematically represented in the figures and described in the following with the help of these exemplary figures and the function of the method as well as the steel structure reinforced thereby is described.

Figure 2:
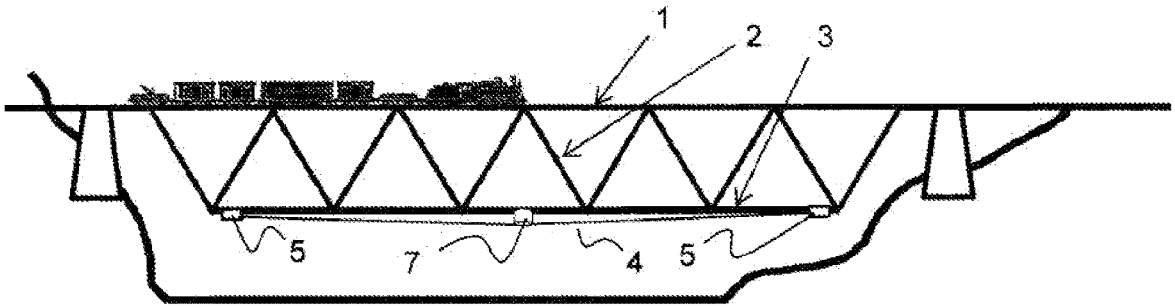
Figure 3:
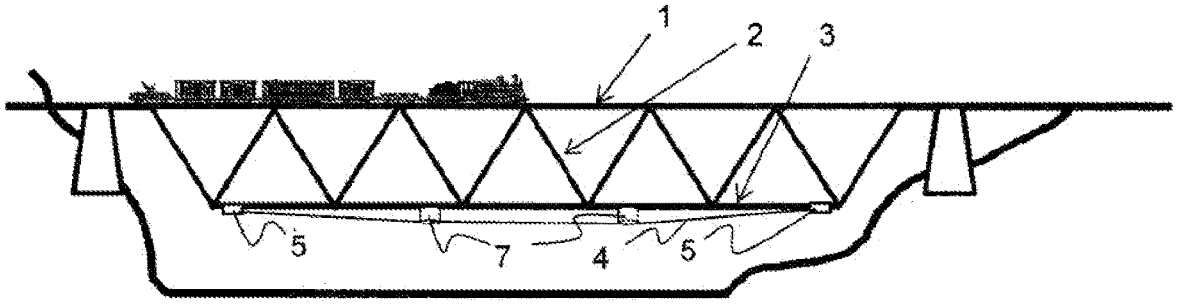
Figure 4:
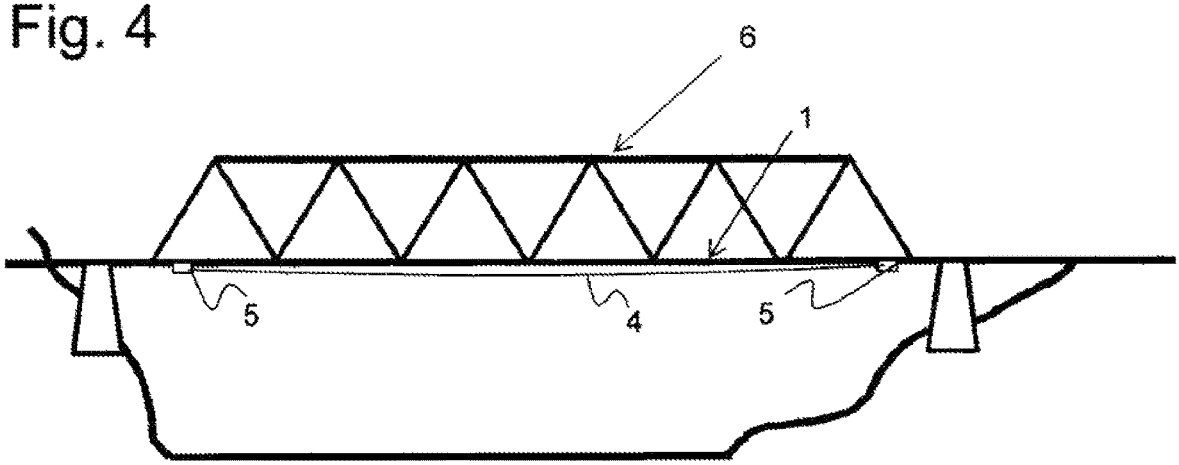
Figure 5:
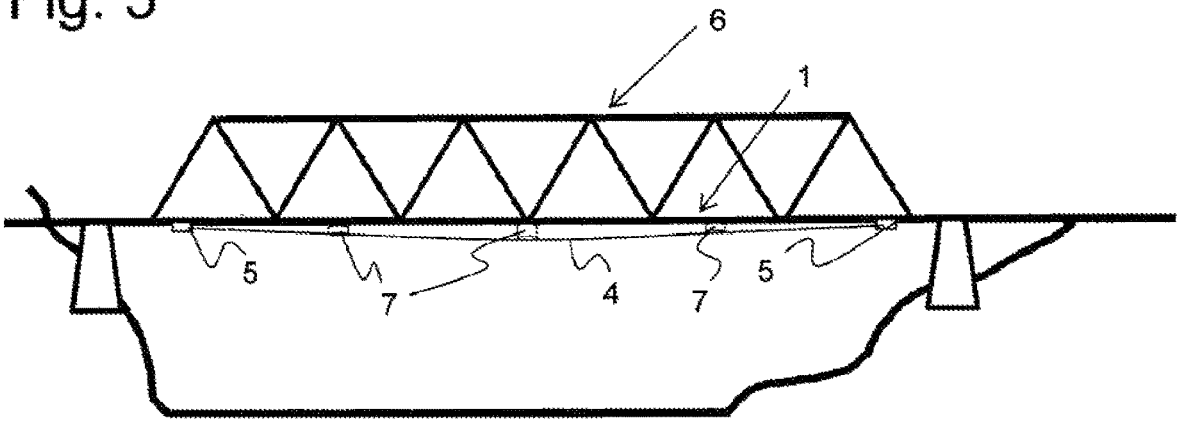
Figure 6:
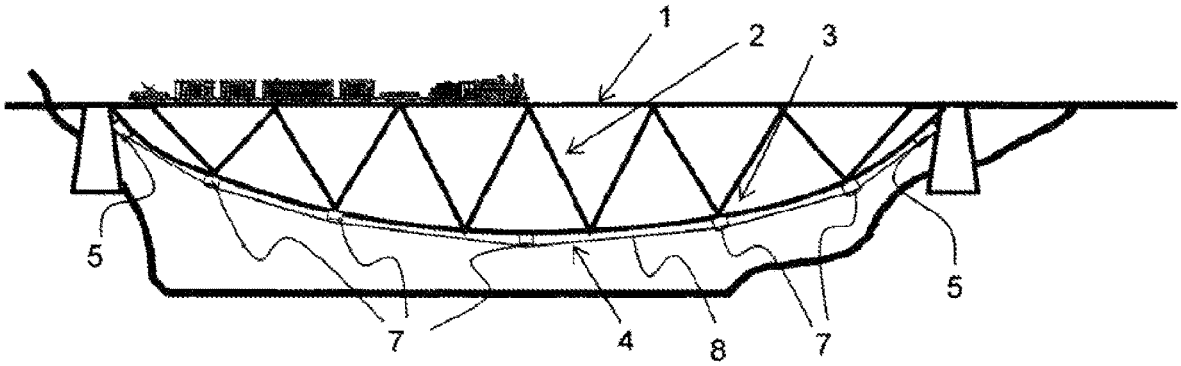

It shows:

FIG. 1: shows a steel structure in the form of a steel bridge with lower struts having a slack with CFRP band joined to the underside thereof subjected to tension;

FIG. 2: shows the steel structure according to FIG. 1 after inserting a lifting element;

FIG. 3: shows the steel structure according to FIG. 1 after inserting two lifting elements;

FIG. 4: shows a steel structure in the form of a steel bridge with upper struts having a slack with CFRP band joined to the underside thereof subjected to tension;

FIG. 5: shows the steel structure according to FIG. 4 after inserting three lifting elements;

FIG. 6: shows a steel structure in the form of a steel bridge with arched lower struts with an applied CFRP band and several lifting elements for pre-stressing thereof.

In FIG. 1, a steel structure is represented in the form of a steel bridge 1 with lower struts 2, wherein the lower-most horizontal steel girder 3 is subjected to tensile stresses. In such steel bridges, there are always steel girders, which are under compression and those which are subjected to tension. In addition, bending moments are caused, especially if the bridge is temporarily loaded, for example when a train rolls over it. Each axle load causes vibrations and these contribute towards material fatigue, so that over the years, cracks may appear in the steel girders, which increasingly weaken the steel girders. It is important to stop this process or at least to slow it down. Since carbon fibre-reinforced polymer bands (CFRP-bands) are exceptionally strong under tensile stresses and also not subjected to any corrosion, they offer to strengthen the steel girders subjected to tensile stresses. The most efficient approach would be to pre-stress the steel girders subjected to tensile stresses by means of such bands. There have been suggestions to subsequently reinforce the concrete structure by pre-stressed bands in order to improve the tensile strength thereof. In this case, the bands are highly pre-stressed by means of special device and positioned next to the concrete structure in this pre-stressed state and laminated on the concrete by means of epoxy resin adhesives. After hardening of the adhesive, the device, which generated and maintained the stress, is removed, whereupon the pre-stressed CFRP band continuously transfers the stresses thereof to the structure. However, such a method cannot be used on steel constructions. First, these generally have no smooth surfaces, and second, the use of adhesives in steel girders proves to be less suitable, because steel constructions are heated to high temperatures under intense sunlight and thus advect/drive-up the adhesive to the borders thereof. Furthermore, the advection of a heavy device for pre-stressing the bands is not feasible in many cases due to ambient conditions or due to lack of space. Especially, this method cannot be used when a bridge stretches at a great height over a vast expanse.

The bridge according to FIG. 1 has a lower strut 2, that means the lower-most horizontal strut 3 is subjected to tensile stress, and it can be reinforced by means of CFPR bands 4, for which the following applies. A CFPR band 4 is joined—over a section or over the entire length of a part of the structure subjected to tension—at both end regions thereof, capable of transferring tensile forces. To achieve this, there are suitable end anchorages 5 from the state of the art, for example in the form of clamping shoes, by means of which the bands 4 are mechanically joined to the steel girder 3 permanently and highly capable of transferring tensile forces. In the example shown, a CFPR band 4 stretches over the entire length of the underside of the lower horizontal steel girder 3, wherein the end anchorages 5 are attached on both sides in the vicinity of the ends of the steel girder 3. Therefore, the band 4 is loosely tensioned. Further, in the example shown, in the middle of the CFPR band 4 that means midway, a lifting element 7 is installed between steel girder 3 and CFPR band 4. This lifting element 7 can be a hydraulically, pneumatically, electrically or mechanically operated lifting element 7, which provides such translation that high lifting forces are generated, for example a few 10 k Newton. Thus, short reaction paths are created with comparatively longer action paths. When such lifting force acts substantially perpendicular to the CFPR band 4 constrained at end regions thereof and it is lifted off from the steel girder 3, then high tensile stresses are generated, widely translated on the CFPR band 4 itself, and these are then transferred to the structure 1 via the end anchorages 5. Thus, the steel girder 3 pre-stressed in such a manner experiences a very substantial reinforcement. If it already has microscopic cracks or even serious cracks, then these can be closed in many cases by means of such pre-stressing or at least it can be achieved that these cracks do not grow further. It should be understood that not just a single CFPR band 4 should be attached, but a multitude of CFPR bands 4 can be installed over the width of the bridge, or even in sections over the length of the bridge, several successive CFPR bands 4 or CFPR bands 4 mutually overlapping in the length can also be attached, which are positioned adjacently and extend parallel to each other, or even overlap in height, thus can be superimposed or intersected. In this case, the bands 4 are not laid exactly in the orientation of the steel girder itself, but laid slightly oblique-angled to it, so that intersections of the bands 4 are formed.

In FIG. 2, the steel structure according to FIG. 1 is shown after inserting a lifting element 7. It was mounted under the attached CFRP band 4 loosely tensioned, for example by means of a mechanical joint with the steel girder 3, by welding or bolting. This lifting element 7 can be constructed similar to a lifting jack, so that it can be hydraulically lifted by means of an external hydraulic pump, in which a hydraulic pipe is temporarily coupled to the lifting element 7. By a corresponding translation, sufficiently large forces can be generated. The elevation is then secured by means of a mechanical latch or by means of mechanical supports. Such mechanical supports are installed after completion of the working stroke of the lifting element 7, which in this case is raised a little above the tensile stress to be finally achieved, besides the lifting element 7, between the band 4 and the steel girder 3 to be reinforced. Then, the lifting element 7 is again relieved a bit, so that the targeted stress is achieved and then the supporting force is absorbed by the supports. As an alternative, the lifting element 7 can also be pneumatically operated. Then, a compressed air pipe can be attached, and the retraction of the lifting element 7 is done by a sufficient translation based on pneumatic pressure. Finally, an electric variant of the lifting element 7 is also possible, in which an enclosed EL-Motor generates a sufficiently large lifting force via a short translation, for example by means of spindles and levers. In this case, just an electric wire is needed to be directed to the lifting element 7, and it can be easily adjusted, when required. Finally, a purely mechanical embodiment is also possible, similarly equipped with spindle and/or levers, wherein the required lifting force is then generated manually or by motor with a crank arm to be attached. In any case, the loosely tensioned CFRP band 4 is tensioned by means of the lifting element 7 and then a high tensile stress is generated on the band 4 due to the lifting action, which is many times greater than the lifting force. While the anchorages 5 practically remain stationary or only marginally yield along with the structure, the travel of the lifting element 7 can be several centimetres. Because of the geometry, in this manner, it follows that very high tensile stresses of x times 10 k N are transferred to the structure.

FIG. 3 shows the steel structure according to FIG. 1 after inserting two lifting elements 7. In case of inserting two lifting elements 7, these are advantageously extended at the same time; so that the stress is build up uniformly distributed over the band length. As an alternative, this can extend one lifting element 7 a little bit, then the second one by a similar amount, then again the first one, then again the second one and so on, so that the tensile force is generated alternately by and by to a certain extent by both the lifting elements 7.

FIG. 4 shows a steel structure in the form of a steel bridge with upper struts 6 with a CFRP band 4 loosely joined therewith. In this case, the fitted CFRP band 4 extends along the lower-most horizontal steel girder, wherein obviously there are several such steel girders in practice, which extend along the bridge, and each is equipped with at least one CFRP band 4, each with two end anchorages 5, which join these to the structure or the said steel girder at the ends of the band 4, capable of transferring the tensile forces.

FIG. 5 shows this steel structure according to FIG. 4 after inserting three lifting elements 7, which are disposed distributed over the length of each CFRP band 4 and in turn extended at the same time or else first of all, both the outer ones are extended a little bit and subsequently the middle one is extended a little further, so that a uniform tensile stress is generated over the entire length of the CFRP band 4.

FIG. 6 finally shows another steel structure in the form of a steel bridge with arched lower strut 2. Here, by the own weight of the bridge 1 and by the loading thereof, a tensile force acts on the arched long girder 8 at the end of the bridge. In this case, CFRP bands 4 are laid and assembled along this curved steel girder 8. In the example shown, a single CFRP band 4 extends over the entire bridge length along the lower girder 8 and is firmly joined to the steel girder 8 of the steel bridge 1 at both the end regions by the anchorage elements 5 attached there. Here, five lifting elements 7 are inserted uniformly distributed over the band length. These are all simultaneously lifted up in order to generate a most uniform or homogenous stress build-up in the CFRP band 4. This tensile force is then transferred to the structure 1 via the anchoring elements 5.

By means of such reinforcements, cracks or gaps in steel structures, i.e. in the elements which are tensioned, are closed in some cases. In other cases, a further growth of these cracks and gaps can be prevented, or at least the weakening process can be substantially slowed down, and overall the structures can be definitely reinforced and stabilized, so that the service life thereof is extended, or optionally, the load bearing capacity is enhanced.

What is claimed is:

1. A steel structure having at least one reinforced steel girder, comprising:

a steel structure having at least one steel girder configured for bearing loads and bending moments;

at least one flat carbon fiber-reinforced polymer (CFRP) band with opposing ends attached mechanically by clamping by friction forces to the at least one steel girder of the steel structure with end anchorages configured to secure the at least one flat CFRP band, no adhesive applied to the at least one steel girder, and the at least one flat CFRP band not being glued on the steel girder by adhesive and having no direct contact with the steel girder; the at least one flat CFRP band being pre-stressed by extending at least one lifting element, disposed between the at least one steel girder and the at least one flat CFRP band and in alignment with attached opposing ends of the at least one flat CFRP band, substantially perpendicular to the at least one flat CFRP band with the end anchorages securing the at least one flat CFRP band; and one or more supports or latches positioned between the at least one steel girder and the at least one flat CFRP band, the one or more supports or latches securing extension of the at least one flat CFRP band resulted from pre-stressing and supporting the at least one CFRP band having a target tensile stress achieved therein after relieving the at least one lifting element; thereby the target tensile stress in the at least one flat CFRP band being transferred to the at least one steel girder and by virtue of a geometry of the at least one flat CFRP band being pre-stressed in a direction perpendicular to the at least one steel girder between the attached opposing ends thereof that are aligned with the at least one lifting element for pre-stressing, wherein no shearing force occurs at locations of the steel girder where the opposing ends of the at least one flat CFRP band are attached, the at least one steel girder in at least a region thereof corresponding to thus pre-stressed at least one flat CFRP band being effectively stabilized and reinforced and having an enhanced capacity of bearing loads and bending moments.

2. The steel structure having at least one reinforced steel girder according to claim 1, wherein the opposing ends of the at least one flat CFRP band are attached by the end anchorages to an underside of the at least one steel girder of the steel structure.

3. The steel structure having at least one reinforced steel girder according to claim 1, wherein the reinforced steel structure comprises multiple said at least one flat CFRP band, and the multiple flat CFRP bands are aligned in parallel.

4. The steel structure having at least one reinforced steel girder according to claim 1, wherein the steel structure is a steel bridge, and the at least one steel girder is the lowermost horizontal steel girder of the steel bridge and bears axle load on the steel bridge.

5. A method of reinforcing at least one steel girder configured for bearing loads and bending moments in a steel structure comprising:

attaching opposing ends of at least one flat carbon fiber-reinforced polymer (CFRP) band mechanically by clamping by friction forces to at least one steel girder of a steel structure with end anchorages configured to secure the at least one flat CFRP band, no adhesive applied to the at least one steel girder, and the at least one flat CFRP band not being glued on the steel girder by adhesive and having no direct contact with the steel girder, wherein the at least one steel girder is configured for bearing loads and bending moments in the steel structure;

disposing at least one lifting element between the at least one steel girder and the at least one flat CFRP band in a region between and in alignment with attached opposing ends of the at least one flat CFRP band;

extending the at least one lifting element substantially perpendicular to the at least one flat CFRP band with the end anchorages securing the at least one flat CFRP band, thereby pre-stressing the at least one flat CFRP band in a direction perpendicular to the at least one steel girder; and securing extension of the at least one flat CFRP band resulted from pre-stressing in the direction perpendicular to the at least one steel girder by one or more supports or latches between the steel girder and the at least one flat CFRP band, thereby the at least one flat CFRP band having a target tensile stress achieved therein being supported by the one or more supports or latches and the target tensile stress in the at least one flat CFRP band being transferred to the at least one steel girder, and by virtue of a geometry of the at least one flat CFRP band being pre-stressed perpendicular to the at least one steel girder between the attached opposing ends thereof that are aligned with the at least one lifting element wherein no shearing force occurs at locations of the steel girder where the opposing ends of the at least one flat CFRP band are attached, the at least one steel girder in at least a region thereof corresponding to thus pre-stressed at least one flat CFRP band being effectively stabilized and reinforced and having an enhanced capacity of bearing loads and bending moments.

6. The method according to claim 5, wherein the one or more supports are mechanical supports.

7. The method according to claim 5, wherein the lifting element is operated hydraulically, pneumatically, electrically or mechanically.

8. The method according to claim 5, wherein said extending the at least one lifting element initially generates a tensile stress in the at least one flat CFRP band greater than the target tensile stress for reinforcing the at least one steel girder, and the target tensile stress is achieved by relieving the at least one lifting element after installing the one or more supports.

9. The method according to claim 5, wherein the opposing ends of the at least one flat CFRP band are attached by the end anchorages to an underside of the at least one steel girder of the steel structure.

10. The method according to claim 5, wherein the method comprises reinforcing the at least one steel girder by multiple of said at least one flat CFRP bands and the multiple flat CFRP bands are aligned in parallel.

11. The method according to claim 5, wherein the steel structure is a steel bridge, and the at least one steel girder is the lower-most horizontal steel girder of the steel bridge and bears axle load on the steel bridge.

12. A method of reinforcing steel girders configured for bearing loads and bending moments in a steel structure comprising:

attaching opposing ends of at least one flat carbon fiber-reinforced polymer (CFRP) band mechanically by clamping by friction forces to each of a plurality of steel girders of a steel structure with end anchorages configured to secure the at least one flat CFRP band, no adhesive applied to the plurality of steel girders, and the at least one flat CFRP band not being glued on the plurality of steel girders by adhesive and having no direct contact with the plurality of steel girders, wherein the plurality of steel girders are configured for bearing loads and bending moments in the steel structure;

disposing at least one lifting element between each of the plurality of steel girders and respective at least one flat CFRP band in a region between and in alignment with attached opposing ends of the respective at least one flat CFRP band;

extending the at least one lifting element substantially perpendicular to respective at least one flat CFRP band with the end anchorages securing the respective at least one flat CFRP band, thereby pre-stressing the respective at least one flat CFRP band in a direction perpendicular to respective steel girder; and securing extension of the respective at least one flat CFRP band resulted from pre-stressing in the direction perpendicular to the respective steel girder by one or more supports or latches between each of the plurality of steel girders and the respective at least one flat CFRP band, thereby the respective at least one flat CFRP band having a target tensile stress achieved therein being supported by the one or more supports or latches and the target tensile stress in the at least one flat CFRP band being transferred to the respective steel girder, and by virtue of a geometry of the respective at least one flat CFRP band being pre-stressed perpendicular to the respective steel girder between the attached opposing ends thereof that are aligned with the at least one lifting element, wherein no shearing force occurs at locations of the respective steel girder where the opposing ends of the respective at least one flat CFRP band are attached, the respective steel girder in at least a region thereof corresponding to thus pre-stressed respective at least one flat CFRP band being effectively stabilized and reinforced and having an enhanced capacity of bearing loads and bending moments.

13. The method according to claim 12, wherein the lifting element is operated hydraulically, pneumatically, electrically or mechanically.

14. The method according to claim 12, wherein said extending the at least one lifting element initially generates a tensile stress in the at least one flat CFRP band greater than the target tensile stress for reinforcing the respective steel girder, and the target tensile stress is achieved by relieving the at least one lifting element after installing the one or more supports.

15. The method according to claim 12, wherein the opposing ends of the at least one flat CFRP band are attached by the end anchorages to an underside of each of the plurality of steel girders of the steel structure.

16. The method according to claim 12, wherein the method comprises reinforcing the respective steel girder by multiple of the at least one flat CFRP bands over a width of the steel structure and the multiple flat CFRP bands are aligned in parallel.

17. The method according to claim 12, wherein the steel structure is a steel bridge, and the plurality of steel girders are the lower-most horizontal steel girders of the steel bridge and bear axle load on the steel bridge.

* * * * *